US009023126B2

(12) United States Patent
Poulalion et al.

(10) Patent No.: US 9,023,126 B2
(45) Date of Patent: May 5, 2015

(54) ADDITIVE FOR TREATING RESULPHURIZED STEEL

(75) Inventors: André Poulalion, Saint Chely d'Apcher (FR); Sébastien Gerardin, Arras (FR)

(73) Assignee: Affival, Solesmes (FR)

( * ) Notice: Subject to any disclaimer, the term of this patent is extended or adjusted under 35 U.S.C. 154(b) by 744 days.

(21) Appl. No.: 12/920,521

(22) PCT Filed: Mar. 3, 2009

(86) PCT No.: PCT/FR2009/050341
§ 371 (c)(1),
(2), (4) Date: Oct. 7, 2010

(87) PCT Pub. No.: WO2009/115722
PCT Pub. Date: Sep. 24, 2009

(65) Prior Publication Data

US 2011/0017018 A1 Jan. 27, 2011

(30) Foreign Application Priority Data

Mar. 3, 2008 (FR) ..... 08 51372

(51) Int. Cl.

| | |
|---|---|
| ***C21B 3/02*** | (2006.01) |
| ***C21C 7/04*** | (2006.01) |
| ***C21C 7/00*** | (2006.01) |
| *C21B 5/02* | (2006.01) |
| *C21B 7/06* | (2006.01) |

(52) U.S. Cl.
CPC ..... *C21C 7/0056* (2013.01); *C21C 7/04* (2013.01)

(58) Field of Classification Search
USPC ..... 75/304, 526
See application file for complete search history.

(56) References Cited

U.S. PATENT DOCUMENTS

| | | | | |
|---|---|---|---|---|
| 4,508,571 | A * | 4/1985 | Nakato et al. | 75/305 |
| 5,268,141 | A * | 12/1993 | Ototani et al. | 420/8 |
| 6,461,402 | B1 * | 10/2002 | Morita et al. | 75/305 |

FOREIGN PATENT DOCUMENTS

| | | | |
|---|---|---|---|
| EP | 1 715 065 | A2 | 10/2006 |
| FR | 2 792 234 | A1 | 10/2000 |
| WO | WO 2005/078142 | A1 | 8/2005 |
| WO | WO 2006/000714 | A2 | 1/2006 |

OTHER PUBLICATIONS

Bergmann et al., "Castability assurance of AL-killed SI-free steel by calcium cored wire treatment," *1st European Conference on Continuous Casting* (Sep. 23-25, 1991) Milan, Italy:1501-1508.
Oelschlagel et al., "Treating steel with Ferrokal wire," *Iron and Steel International* (1981) 54 (6): 323-330.
Murray et al., "Use of cored wire to introduce metallic powders into molten metal," *Metallurgist* (1997) 41 (1-2): 53-55.
"Slag Atlas", *2nd Edition, Verein Deutscher Eisenhiittenleute (VDEh)*, ISBN 3-514-00457-9, (1995), pp. V-XVIII & 105.

* cited by examiner

*Primary Examiner* — Kaj K Olsen
*Assistant Examiner* — Alexander Polyansky
(74) *Attorney, Agent, or Firm* — Merchant & Gould

(57) ABSTRACT

A cored wire for introducing additive into a bath of liquid steel, of the type comprising a metal sheath surrounding said additive, characterized in that said additive predominantly comprises calcium silicate.

Figure 1:
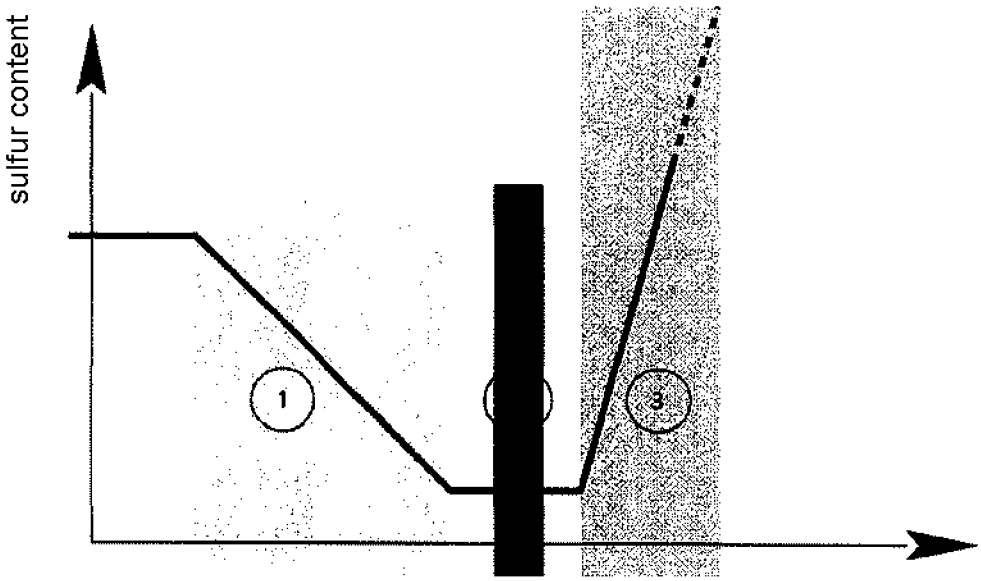

A process for manufacturing a resulfurized steel, characterized in that it comprises a step of introducing, into the bath of liquid steel, such a cored wire.

9 Claims, 4 Drawing Sheets

ADDITIVE FOR TREATING RESULPHURIZED STEEL

This application is a National Stage Application of PCT/FR2009/050341, filed Mar. 3, 2009, which claims benefit of Serial No. 0851372, filed Mar. 3, 2008 in France and which applications are incorporated herein by reference. To the extent appropriate, a claim of priority is made to each of the above disclosed applications.

The present invention lies in the technical field of cored wires for the introduction of an additive into a bath of liquid steel, of the type comprising a metal sheath surrounding said additive, for treating special steels known as resulfurized steels, especially those killed with aluminum. The invention also relates to a process for manufacturing resulfurized steels using the abovementioned cored wire.

Steels that are considered as being resulfurized are those whose manufacturing process involves addition of sulfur to the bath of liquid metal. Resulfurized steels are steel grades whose production via the "continuous casting" route is sometimes difficult to master, all the more so when the contents of S (sulfur) and Al (aluminum) are high. The reason for this is that the flowability of these steel grades in continuous casting degrades when the S and Al contents are high, which is typically the case for an S content of greater than 0.25% by weight and an Al content of greater than 0.03% by weight. The flowability of the steel depends closely on the presence in the steel of solid particles in suspension (inclusions) at the time of its passage through the continuous casting distributor. These solid particles may be oxides, for instance alumina ($Al_2O_3$), or sulfides (CaS), which attach easily to the refractory walls of continuous casting components (plungers, nozzles, etc.) forming deposits, which lead to clogging. Moreover, these solid particles degrade the quality of semi-finished products and thus the final working properties of the steels.

There is no clogging and the flowability is good if the inclusions are liquid at the time of passage of the steel into the distributor. When liquid, the inclusions cannot form deposits on the refractory casting components. It is sought to satisfy this condition in the standard metallurgical process, by means of several steps performed upstream of the continuous casting.

Solid oxide inclusions of the type such as alumina ($Al_2O_3$) or spinels ($Al_2O_3$—MgO) are essentially formed during the deoxidation of the steel (operation known as killing) or even during reoxidations of the bath of liquid metal during the production process. These inclusions must mandatorily be converted into liquid inclusions by addition of calcium (inclusion treatment), generally in the form of cored wire that may contain CaSi or pure Ca. The calcium thus introduced into the steel combines with the solid inclusions to form novel compounds of the type $Al_2O_3$—CaO or $Al_2O_3$—CaO—$SiO_2$ that are liquid at the casting temperature of the treated steel. WO 2005/078 142 and above all WO 2006/000 714 A2 thus disclose various processes for treating solid inclusions, consisting in introducing a cored wire into a bath of liquid steel close to the very bottom of the ladle so as to prevent the additives contained in the cored wire from vaporizing before reaching a sufficient depth and/or from reacting at the surface with the slag. The additives in question are especially materials containing calcium for the purpose of treating the endogenous inclusions.

However, if the sulfur content of the bath of liquid steel is too high at the time of addition of calcium, the calcium introduced may combine with the sulfur to form solid calcium sulfides (CaS) that are harmful to the flowability. In this case, it is imperative to perform a desulfurization of the steel before adding calcium (Ca), in order to reach a sufficiently low sulfur (S) content, compatible with the addition of a large amount of calcium (Ca). Next, only after the inclusion treatment, the resulfurization may be performed to achieve the sulfur level stipulated by the specifications.

The attached FIG. 1 diagrammatically represents the standard metallurgical process, which includes the three main steps presented above:

step 1: desulfurization of the steel (period which may require several tens of minutes);

step 2: inclusion treatment;

step 3: resulfurization of the steel.

The present invention proposes to simplify the metallurgical process for the manufacture of resulfurized steels (or steels with a high sulfur content), thus affording a gain in productivity, while ensuring an equivalent level of quality and good flowability of the steels obtained.

To this end, the invention relates, according to a first aspect, to a cored wire for the introduction of an additive into a bath of liquid steel, said cored wire being of the type comprising a metal sheath surrounding said additive, and characterized in that said additive predominantly comprises (at least 85% by weight) calcium silicate. Calcium silicate is derived from the reaction in given proportions of lime (CaO) with silica ($SiO_2$). Calcium silicate is usually described in the prior art in the form of the following binary mixture: ($CaO.SiO_2$) in which the weight proportion of lime (CaO) relative to that of silica ($SiO_2$) is adjusted especially as a function of the melting point targeted for the calcium silicate obtained.

The cored wire according to the invention comprises a mixture of oxides based on calcium silicate ($CaO.SiO_2$) that advantageously makes it possible to eliminate the abovementioned preliminary desulfurization step 1 (saving several tens of minutes) and to avoid the addition of calcium (Ca) (in any form: CaSi or pure Ca), while at the same time ensuring efficient treatment of the solid inclusion population of the bath of liquid steel, which is compatible with continuous casting techniques. This cored wire containing the mixture of oxides based on $CaO.SiO_2$ effectively makes it possible, when it is introduced into liquid steel, to modify the nature and morphology of the solid oxide inclusions present in the bath of liquid steel without running the risk of forming harmful solid sulfides. Thus, the calcium silicides added in the known inclusion treatments of the prior art, especially of document WO 2005/078 142, should not be confused with calcium silicon oxides, which are the calcium silicates ($CaO.SiO_2$) according to the present invention.

The cored wire according to the invention makes it possible, when it is introduced into a bath of liquid steel, to convert the solid inclusions present in the liquid steel (essentially oxides such as $Al_2O_3$) that are the cause of clogging of continuous castings, into liquid inclusions—at the casting temperature of the treated steel—which flow easily. The formed oxide inclusions may advantageously be charged with sulfur (S) during the solidification of the steel, but there is no formation of calcium sulfide (CaS), i.e. of inclusions that are solid at the casting temperature of the treated steel comprising sulfur (S).

In one variant, said additive comprises a content of lime (CaO) ranging between 31% and 44% by weight and a content of silica ($SiO_2$) ranging between 56% and 69% by weight.

Figure 2:
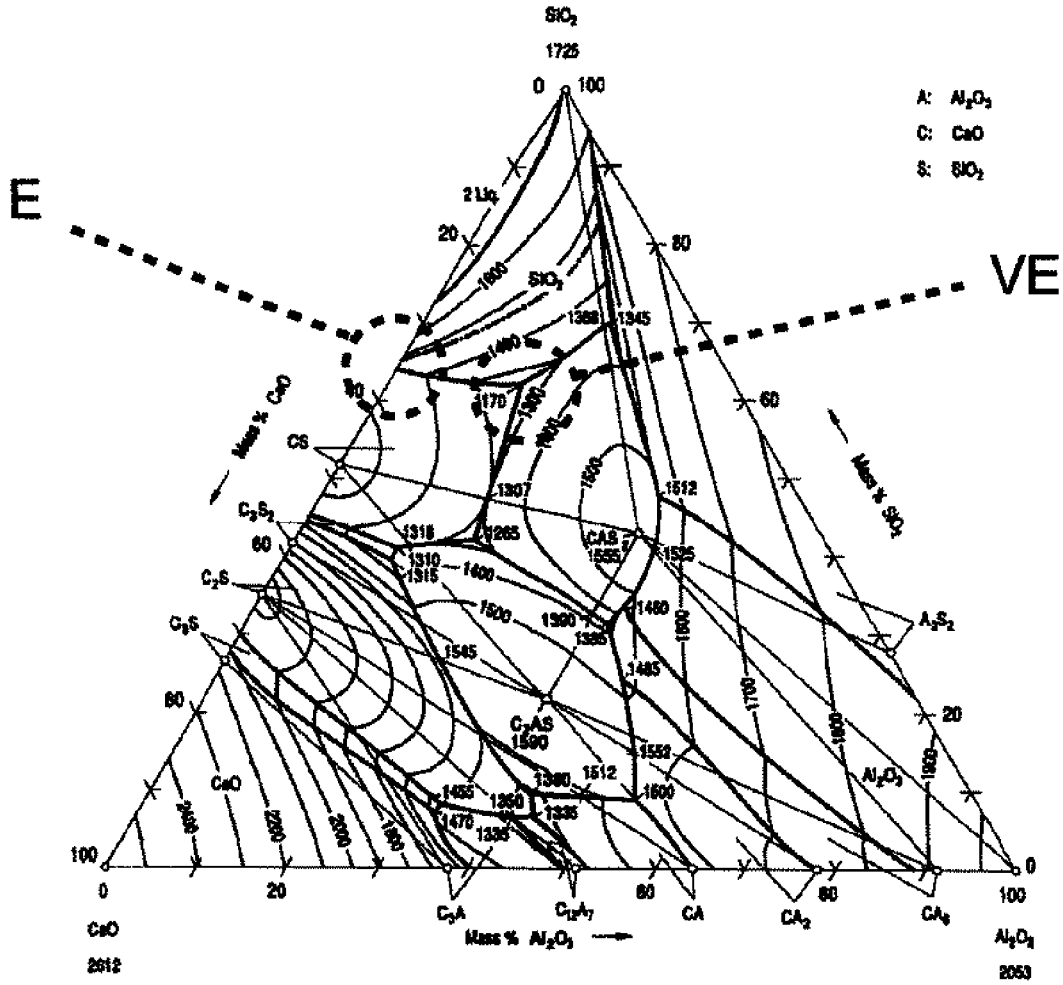
Figure 3:
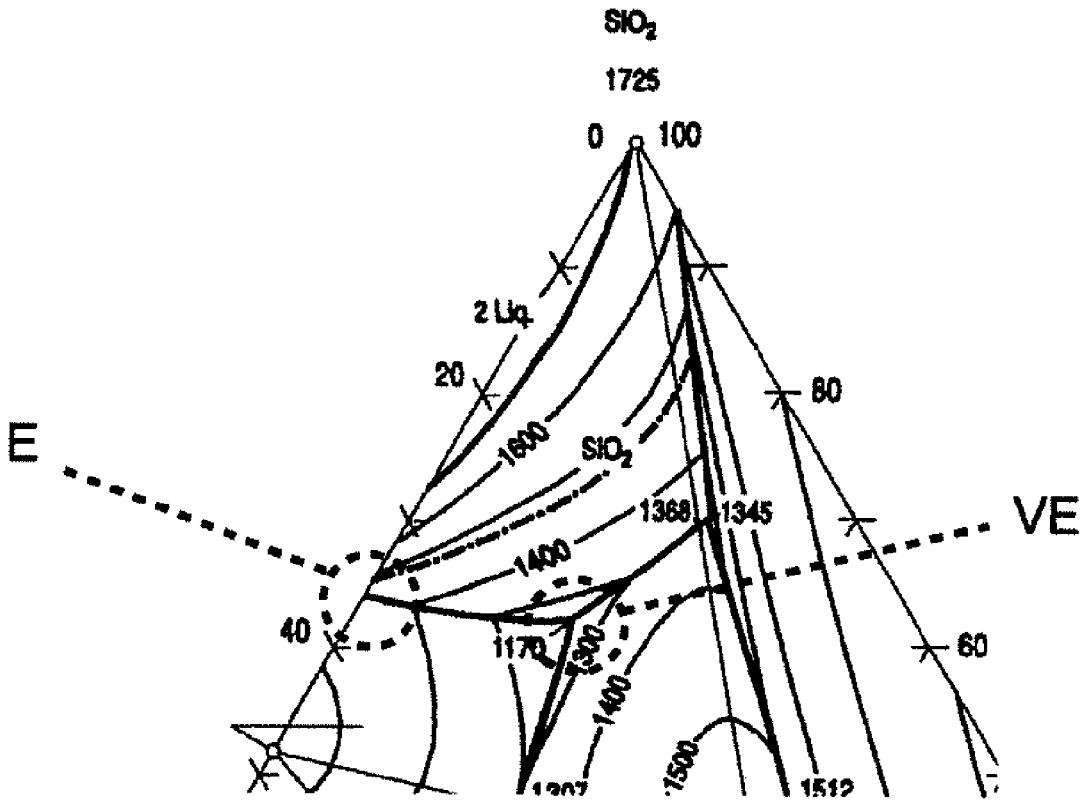

The proportions of lime and silica are determined so as to correspond to the values contained in the circular area delimited by dashes in the region of the eutectic point referenced E in FIGS. 2 and 3, representing the $Al_2O_3$—CaO—$SiO_2$ ternary diagram. These proportions are optimal so as to obtain a calcium silicate ($CaO.SiO_2$) with a melting point less than or equal to the working temperature of the treated liquid steel. The precise point E denotes the preferred proportions of lime and silica in the calcium silicate binary mixture.

According to a second aspect, the invention relates to a process for manufacturing special "resulfurized" steels, said process including a step of introducing, into the bath of liquid steel, a cored wire of the invention. These steels have a sulfur content that ranges from 0.02% to more than 0.25% by weight.

In one preferred implementation variant, the process of the invention is directed toward the manufacture of aluminum-killed resulfurized steels.

Characteristically, the process according to the invention makes it possible to treat solid inclusions, especially of aluminum oxide $Al_2O_3$, contained in baths of liquid steels intended for the production of steels with a high sulfur content, without it being necessary to desulfurize the steel beforehand, while ensuring modification of the solid inclusions and improvement of the flowability required for modern continuous casting tools.

In one variant, the process according to the invention includes a first step for obtaining a liquid steel base, for example by melting scrap metal, a second step of deoxidation, a third step of grading, a fourth step of degassing, and a fifth step of treating the solid inclusions using a cored wire according to the invention.

The second step consists in deoxidizing the bath of liquid steel that contains a very large amount of dissolved oxygen, which is incompatible with the subsequent manufacturing processes. The dissolved oxygen is especially fixed by means of adding aluminum to the bath of liquid steel. This second step is commonly known as "killing". The dissolved oxygen and the aluminum then combine to form solid inclusions of alumina ($Al_2O_3$) which will need to be converted into liquid inclusions by modifying their chemical composition for the purpose of the continuous casting step.

In one variant, the third step of grading is the final grading of the liquid steel, optionally of the sulfur content.

Since the step of desulfurization of steels containing sulfur—an essential prior step to the inclusion treatment using silico-calcium as known in the prior art—is eliminated in the process according to the invention, the adjustment of the sulfur content in accordance with the specifications may be performed, for example, during the first grading before the inclusion treatment.

In one variant, said process does not include a desulfurization step before the step of treating the solid inclusions, especially before the fifth step of treating the solid inclusions.

In one variant, said process includes a step of gentle gas stirring for homogenization of the ladle of liquid steel after the fifth step of treating the solid inclusions, preferably using a porous plug located at the bottom of the ladle of liquid steel.

The function of this step is to homogenize the distribution of the inclusions.

The invention also relates to the use of the abovementioned cored wire for improving the flowability of baths of resulfurized steel.

The invention will now be described in detail.

The aim of the present invention is to replace the known metallurgical treatment, for controlling the flowability of a bath of liquid steel, especially resulfurized steel, by means of a treatment using an additive based on calcium silicate.

A preferred means used for introducing said additive into the bath of liquid metal is the cored wire technique, which is renowned for its efficacy and its simplicity.

The cored wire for the introduction of additive into a bath of liquid steel, according to the invention, is of the type comprising a metal sheath surrounding said additive. Advantageously, said additive essentially comprises calcium silicate that is capable of interacting with the solid inclusions present in the liquid steel (especially aluminum oxides $Al_2O_3$) and of converting them into liquid inclusions that flow easily and thus prevent clogging of the continuous castings.

The additive intended to be introduced into the bath of liquid steel, by means of the cored wire according to the invention, may also comprise a flux (such as fluorides), whose role is to lower the melting point of the additive contained in the cored wire, so as to liquefy it as soon as it is introduced into the bath of liquid steel and to keep it liquefied, since only a liquid composition based on calcium silicate can absorb the solid particles present in the bath of steel. The proportion of flux in the additive is less than or equal to 10% by weight.

The additive intended to be introduced into the bath of liquid steel, by means of the cored wire according to the invention, may also comprise another metal oxide such as FeO, MnO or MgO. The proportion of these metal oxides in the additive is less than or equal to 2% by weight.

The function of this metal oxide is to lower the melting point of said additive. Beyond 2% by weight of said additive, said additive has a tendency to form solid inclusions at the casting temperature.

According to a second aspect, the invention relates to a process for manufacturing special "resulfurized" steels, said process including a step of introducing, into the bath of liquid steel, cored wire of the invention.

The process of the invention includes a metallurgical treatment for modifying the nature and morphology of the inclusions present in a bath of liquid steel (especially solid inclusions), at a precise moment in the production of resulfurized steels.

This metallurgical treatment consists in introducing into the bath of liquid steel a cored wire according to the invention, comprising an additive based on calcium silicate that is capable of acting on solid inclusions, especially alumina, converting them into liquid inclusions, thus improving the flowability of the treated steel.

The exact mechanism of interaction between the inclusions based on calcium silicate introduced into the bath of liquid steel by means of the cored wire containing the additive and the endogenous solid inclusions present in a bath of liquid steel (especially $Al_2O_3$) is not known. Quite probably, it is a physical process of absorption of the alumina by the calcium silicate, which leads to the formation of $Al_2O_3$—CaO—$SiO_2$ complex compounds.

The mixture of oxides contained in the cored wire according to the invention has the particular feature of having a low melting point. The strictly binary mixture CaO—$SiO_2$ has a eutectic point at 1436° C. (for 63% $SiO_2$). This melting point may be reduced if the mixture is combined with other constituents such as metal oxides (FeO, MnO, MgO) or fluxes, for instance such as $CaF_2$.

The working temperatures during the production of the liquid steel are much higher than the melting point of the mixture of oxides contained in the cored wire. It follows therefrom that the cored wire introduced into the bath of liquid steel releases fine particles of liquid oxides.

These liquid inclusions, rapidly distributed throughout the ladle of liquid steel, have a high capacity for taking up solid inclusions of alumina or spinels. As a result, the nature and morphology of these endogenous inclusions are modified. The composition of the desired inclusions is indicated in the attached FIG. 2, which shows the $Al_2O_3$—CaO—$SiO_2$ ternary diagram (according to [1]). In the attached FIGS. 2 and 3, E represents the eutectic point of the "binary alloy" CaO—$SiO_2$, and VE represents the composition of the desired inclusions after the inclusion treatment. In the attached ternary diagram, the eutectic point E corresponds to the reversible conversion of a liquid phase into two distinct solid phases. Thus, the binary mixture that is preferred in the context of the present invention comprises, on a weight basis, 56% to 69% silica ($SiO_2$) and 31% to 44% lime (CaO).

In FIG. 2, VE represents the lowest melting point (1172° C.) of a given ternary mixture $Al_2O_3$—CaO—$SiO_2$, which is determined from the eutectic point E, such that the inclusions having this composition in fact have a melting point very much lower than that of the steel. Thus, the inclusions are liquid at the working temperature.

In the rest of the process, these inclusions will be able to decant and to be taken up in turn by the ladle slag. The small inclusions not removed will have no incidence either on the flowability or on the final properties of the steel.

This process has several advantages. It especially constitutes a mild treatment of steel in the liquid state, unlike the known treatment based on silico-calcium (CaSi) and all the more so with regard to a standard treatment with pure calcium (Ca), characterized by a very energetic reaction of the calcium that undergoes sublimation (passage from the solid state to the vapor state) during its introduction into the bath of liquid steel. In addition, this process does not lead to the formation of calcium sulfides that are harmful to the flowability.

The process according to the invention is particularly suited to the treatment of the solid inclusions present in baths of steel comprising aluminum.

Above all, the process according to the invention makes it possible to significantly reduce the time for producing such steels since the desulfurization step can be purely and simply eliminated. This saving in time is reflected directly in terms of a gain in productivity, but also in terms of a saving in energy, especially electrical energy, and in materials. The reason for this is that desulfurization of the liquid steel makes it necessary to control the chemical composition of the slag (additions of lime, alumina or aluminum, for example), to perform intense bubbling in the ladle (sparging of gas via the porous plug, especially of argon) to promote the chemical exchanges between the liquid steel and the slag, and in parallel to heat the bath of liquid steel (large consumption of electrical energy). Finally, the invention makes it possible to dispense with the injection of cored wires containing CaSi or pure Ca.

Figure 4:
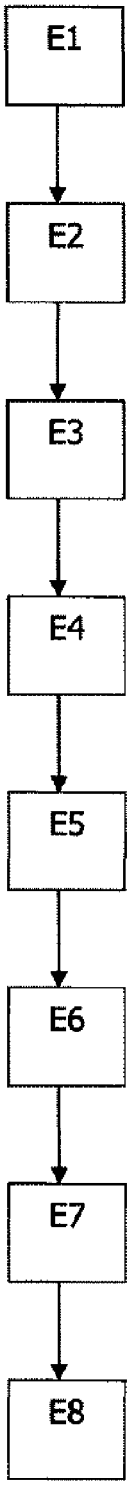
Figure 5:
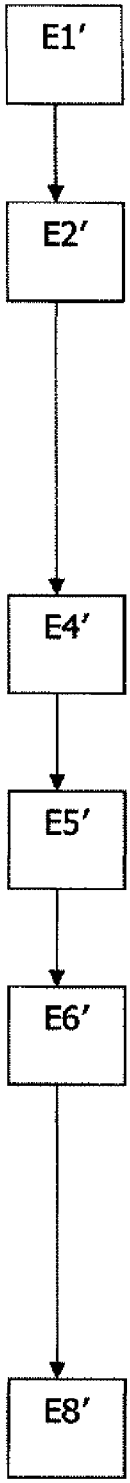

FIGS. 4 and 5 attached hereinbelow illustrate the main steps of a process for treating an aluminum-killed resulfurized steel given as a nonlimiting example and as known in the prior art for FIG. 4 and improved according to the present invention for FIG. 5. The grade of steel treated is the same for the two processes illustrated in FIGS. 4 and 5. It is a 29MnCr5 steel with a sulfur content of between 0.020% and 0.040% by weight and an aluminum content of between 0.015% and 0.040% by weight.

The process described in FIG. 4 includes a first step $E_1$ of melting the steel to be treated, a second step $E_2$ of deoxidation (killing), a third step $E_3$ of desulfurization, a fourth step $E_4$ of grading the steel to be treated in a ladle furnace (with the exception of the sulfur content), a fifth step $E_5$ of degassing, a sixth step $E_6$ of inclusion treatment using a cored wire containing an additive based on calcium (CaSi or pure Ca), a seventh step $E_7$ of sulfur grading, and finally an eighth step $E_8$ of continuous casting of the treated steel.

The third step $E_3$ of desulfurization consists in desulfurizing the liquid steel especially by means of chemical exchanges between the steel and the supernatant slag. This desulfurization step is complex to perform since it requires perfect control of the chemical composition of the slag to enable optimum chemical exchanges with the liquid steel for the purpose of the sixth step $E_6$ relative to the inclusion treatment. As a function of the quality of the slag and of the sulfur (S) content of the untreated steel, the second step $E_2$ of desulfurization requires a minimum time, at least 20 minutes in most of the known manufacturing processes, in order to reduce the sulfur content for the purpose of the subsequent sixth step $E_6$ of treatment of the inclusions.

The sixth step $E_6$ of treatment of the inclusions is performed using a silico-calcium (CaSi) cored wire, in this specific example based on an alloy and comprising 30% Calcium.

The seventh step $E_7$ of sulfur grading for the final steel grading according to the specifications takes place only after a minimum waiting period, at least five minutes, following the sixth step $E_6$. This waiting period makes it possible to reduce the probability of the sulfur combining with the calcium injected via the cored wire and thus avoids the formation of calcium sulfides (CaS) forming solid inclusions at the casting temperature of the treated steel, which are therefore harmful to the flowability in continuous casting.

The process according to the invention, as illustrated in FIG. 5, advantageously makes it possible to dispense with the third step $E_3$ of desulfurization and the seventh step $E_7$ of final grading of the treated steel. The second step $E_2$, of grading the steel to be treated in a ladle furnace, consists of the final grading of the steel to be treated according to the specifications, including the sulfur content. The sixth step $E_6$ of treating the inclusions is performed using a cored wire according to the present invention, comprising, in this specific example, a mixture of calcium silicate ($CaO.SiO_2$) and of manganese oxide (MnO) in the following weight proportions: $SiO_2$: 65.2%; CaO: 33.7%; MnO: 1.1%. The outside diameter of said cored wire is about 13.5 mm, the metal sheath has a thickness of about 0.35 mm and the cored wire has a linear mass of about 227 g/m. The temperature of the steel ladle into which the cored wire is injected is about 1592° C. and the amount of cored wire injected is about 250 g per tonne of steel. After the sixth step $E_6$ of treating the inclusions, gentle homogenizing gas stirring using a porous plug located at the bottom of the ladle is performed for 7 minutes. The steel ladle is then ready to be transferred for continuous casting.

The flowability recorded in the eighth step $E_8$ is in accordance with the average level recorded in a known standard process of the prior art, such as that illustrated in FIG. 4. In this specific example, the content of defects recorded in continuous casting is 4.5% for the process illustrated in FIG. 5, as opposed to an average level of 4.92% for the known process illustrated in FIG. 4. In addition, the oxygen content just before the fifth step $E_5$ of degassing is 22 ppm. The oxygen content measured in the distributor, when the ladle still contains 70 tonnes of steel, is 15 ppm.

Advantageously, the process illustrated in FIG. 5 makes it possible to significantly reduce the production time of such steels since the desulfurization step $E_3$ may be purely and simply omitted. This time-saving is reflected directly in terms of a gain in productivity, but also in terms of a saving in energy, especially electrical energy, and in materials. The reason for this is that desulfurizing liquid steel makes it necessary to control the chemical composition of the slag (for example addition of lime, alumina, aluminum), to perform intense gas stirring in the ladle (blowing of gas via the porous plug—consumption of argon) to promote the chemical exchanges between the liquid steel and the slag, and in parallel to heat the bath of liquid steel (large consumption of electrical energy).

The productivity of the process for producing steels with a high sulfur content is thus considerably improved. Similarly, the process according to the invention makes it possible to reduce the consumption of sulfur that needs to be added to the liquid steel in order to satisfy the specifications, and to dispense with the addition of CaSi or of pure Ca for the inclusion treatment.

In this specific example, the size of the ladle is 105 tonnes and the final grade of the treated 29MnCr5 steel is as follows:

C: 0.285%
Mn: 1.298%;
Cr: 1.174%;
Si: 0.322%
S: 0.029%;
Al: 0.035%.

BIBLIOGRAPHIC REFERENCE

[1]—Slag Atlas, 2$^{nd}$ edition, edited by Verein Deutscher Eisenhüttenleute (VDEh), ISBN 3-514-00457-9

The invention claimed is:

1. A cored wire for introducing additive into a bath of liquid steel, comprising a metal sheath surrounding said additive, wherein said additive comprises at least 85% calcium silicate by weight.

2. The cored wire as claimed in claim 1, in which said additive comprises a lime (CaO) content ranging between 31% and 44% by weight and a silica ($SiO_2$) content ranging between 56% and 69% by weight.

3. The cored wire as claimed in claim 1, in which said additive also comprises another metal oxide.

4. The cored wire as claimed in claim 3, in which the concentration of said other metal oxide in the additive is less than or equal to 2% by weight.

5. The cored wire as claimed in claim 1, in which said additive also comprises a flux.

6. The cored wire as claimed in claim 5, in which the concentration of flux in the additive is less than or equal to 10% by weight.

7. The cored wire as claimed in claim 5, in which said flux is a fluoride.

8. The cored wire of claim 3, wherein said other metal oxide is selected from the group consisting of FeO, MnO, and MgO.

9. The cored wire of claim 7, wherein said fluoride is $CaF_2$.

* * * * *